US009484632B2

(12) United States Patent
Lavedas

(10) Patent No.: US 9,484,632 B2
(45) Date of Patent: Nov. 1, 2016

(54) DIPLEXING AND TRIPLEXING OF LOOP ANTENNAS

(71) Applicant: Raytheon Company, Waltham, MA (US)

(72) Inventor: Thomas G. Lavedas, Clifton, VA (US)

(73) Assignee: Raytheon Company, Waltham, MA (US)

( * ) Notice: Subject to any disclaimer, the term of this patent is extended or adjusted under 35 U.S.C. 154(b) by 491 days.

(21) Appl. No.: 13/936,664

(22) Filed: Jul. 8, 2013

(65) Prior Publication Data

US 2015/0009088 A1 Jan. 8, 2015

(51) Int. Cl.

| | |
|---|---|
| ***H01Q 21/00*** | (2006.01) |
| ***H01Q 7/00*** | (2006.01) |
| ***H01Q 21/28*** | (2006.01) |

(52) U.S. Cl.

CPC ..... *H01Q 7/00* (2013.01); *H01Q 21/28* (2013.01)

(58) Field of Classification Search

USPC ..... 343/700 MS, 702, 867, 742

See application file for complete search history.

(56) References Cited

U.S. PATENT DOCUMENTS 7,714,791 B2 * 5/2010 Lavedas ..... H01Q 1/2216 343/742

* cited by examiner

*Primary Examiner* — Hoang V Nguyen
*Assistant Examiner* — Hai Tran
(74) *Attorney, Agent, or Firm* — Daly, Crowley, Mofford & Durkee, LLP

(57) ABSTRACT

An antenna system comprising a plurality of loop antenna sets with each of the plurality of loop antenna sets disposed in one of a plurality of different parallel planes with each of the planes being spaced apart from another adjacent plane and wherein loop antenna set in the plurality of loop antenna sets comprises a plurality of loop antennas and wherein the plurality of loop antennas are configured such that the near field inductive coupling between the plurality of loop antenna sets is zero. The absence of inductive coupling between the loop elements provides a frequency-independent means for multiplexing signals for transmission and reception by the multiple loop antenna system.

24 Claims, 16 Drawing Sheets

DIPLEXING AND TRIPLEXING OF LOOP ANTENNAS

FIELD

The concepts, systems, circuits, devices and techniques described herein relate generally to radio frequency (RF) circuits and more particularly to RF matching circuits.

BACKGROUND

The system and techniques described herein relate generally to radio frequency (RF) communications and, more particularly, to antennas and antenna systems for RF communications in hear-field sensing applications such as, but not limited to, radio frequency identification (RFID) systems.

As is known in the art, radio frequency identification systems are typically wireless, non-contact systems that utilize radio frequency electromagnetic fields to transfer information from an RFID card or tag to a reader for the purposes of automatic identification and/or tracking. RFID systems are used in a wide variety of different applications including, but not limited to, evacuation management, security systems, asset tracking, manufacturing, and people (e.g., students, employees) tracking.

As is also known, electrically small loop antennas, that is, those having electrical dimensions less than about one-eighth of a wavelength, often used in near-field sensing applications, have limited bandwidths, commonly less than a one or two percent of the operating frequency. Many applications require that the loop antenna operate over a bandwidth which is wider than the naturally occurring operating bandwidth of loop antennas. To expand the operational bandwidth of such loop antennas, it is common to reduce the antenna efficiency. Thus, in some applications, a trade-off must be made between operating bandwidth and efficiency of the loop antenna. One such application is in the reading of RFID cards that conform to the applicable International Standards Organization standard, ISO-14443.

The antenna used as part of an interrogation system for typical RFID cards must have a bandwidth sufficient to provide reasonable gain at the card's response sub-carrier frequency, which is 483 kHz away from the carrier signal that provides the card's power. This generally limits the maximum antenna Q to no more than about 40, which limits the distance at which a card can be read for a given interrogation power.

Other applications abound where small antennas are desirable but have limited utility because of their limited bandwidths.

What is needed is a high efficiency, wide bandwidth yet physically small antenna system for use in RFID and near-field sensing applications that enable the transmission of short duration pulses and/or the rapid and efficient transfer of high-bandwidth data.

SUMMARY

In contrast to the above-described conventional approaches, embodiments of the invention are directed to a system of antenna loops configured such that the near field inductive coupling between the sets of loops is substantially zero. This is achieved by selecting geometric relationship between pairs of loops (i.e. selecting the geometric configuration and position of each loop). Specifically, the current resulting in one pair of loops from the mutual inductance between that pair and a second pair is equally distributed between those having one sense, say clockwise, and those of the opposite sense, say counter-clockwise, such that the mutually induced currents between the two pairs of loops sum to zero.

In one implementation, the pairs of loops occupy two closely spaced planes, two loops in each plane. Selection of appropriate spacings between the pair of loops collocated in each of the two planes and the spacing between the planes results in the mutually induced current terms summing to substantially zero. This assures that the loop pairs are not coupled inductively, thereby making it possible for the currents that flow in each pair to be in a sense orthogonal to each other. This permits each pair of loops to be treated as separate antennas that are isolated from each other. Each paired-loop sub-antenna can thus be tuned to a different operating state and used in conjunction to support a signal having a broader bandwidth and/or alternatively, to support completely independent signals in a single antenna assembly, diplexing, triplexing, or higher-order combinations.

Using geometric relationships between loop antennas provides a frequency-independent means of multiplexing signals onto an antenna. That is, the signals can be at different or overlapping frequencies, as desired. No prohibited band is present as there is in conventional, frequency based diplexers or triplexers.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
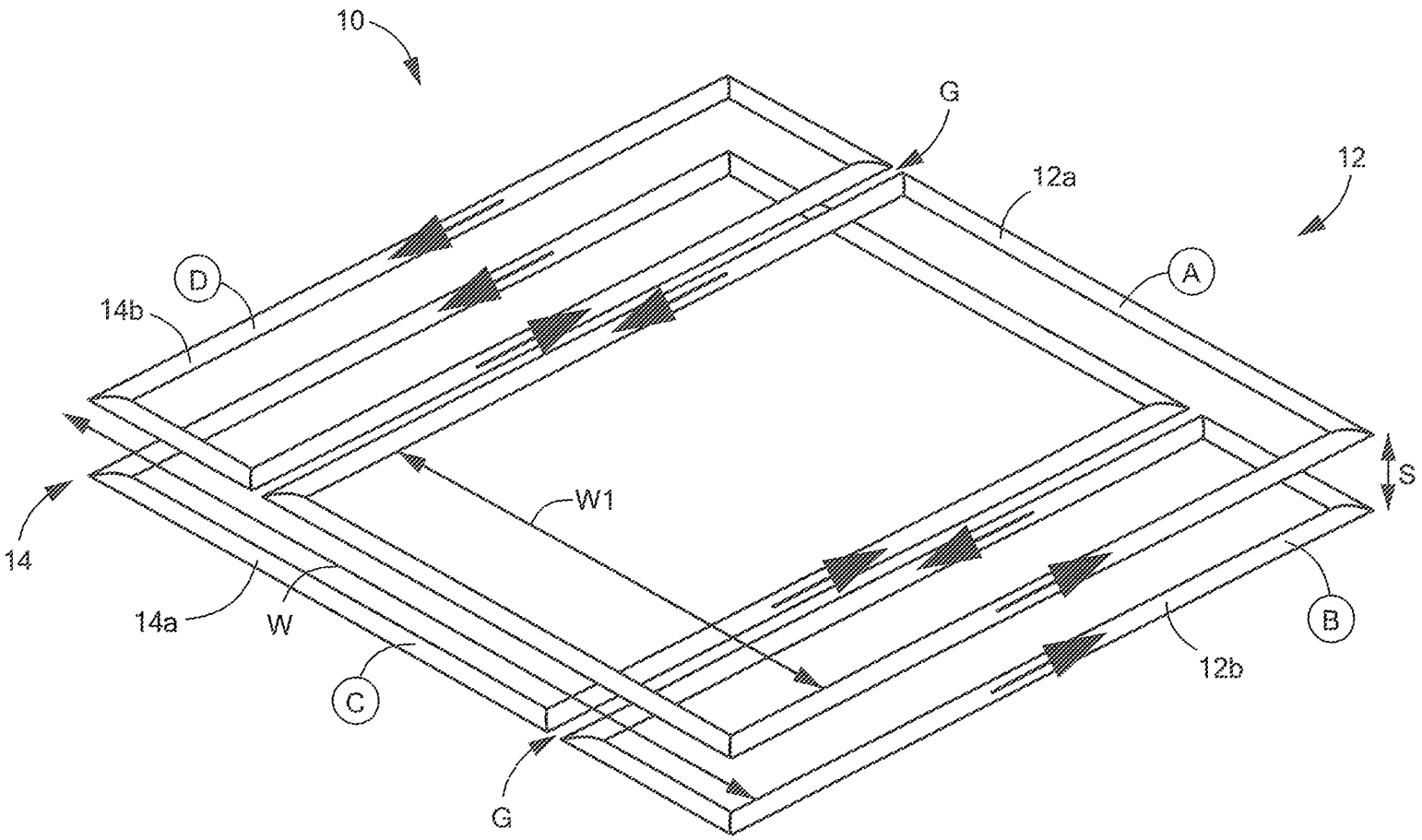
FIG. 1 is a diagram of a two-layer orthogonal loop antenna, according to one embodiment of the present invention.

Before describing a system of loop antennas that provide a frequency independent means of multiplexing signals and the techniques associate therewith, it should be noted that reference is sometimes made herein to a specific type of near-field radio frequency (RF) communications system referred to as radio-frequency identification (RFID) system. It should be appreciated that such references are made in an effort to promote clarity in the description of the concepts disclosed herein. It should be understood that such references are not intended as, and should not be construed as, limiting the use or application of the concepts, systems, circuits, and techniques described herein to use with RFID systems.

Rather, it should be appreciated that the concepts, systems, circuits and techniques described herein find application in a wide variety of different types of transponder systems and other RF systems. Such systems include, but are not limited to, proximity readers, near-field sensing systems, shortwave transceivers, concealed or covert communications applications.

Accordingly, those of ordinary skill in the art will appreciate that the concepts, circuits and techniques described herein within the context of an RFID system could equally be taking place in other types of RF communication and/or transponder systems or networks, without limitation.

Embodiments of the present system are directed toward an antenna system comprised of a system of loops configured such that near field inductive coupling between certain sets of loops is zero. Specifically, this is achieved through selection of geometric relationship of pairs of loops such that mutual inductance between pairs is of the opposite sense. Selecting an appropriate spacing between sets of loops results in any currents generated due to the inductive coupling between loops summing to substantially zero. Since the loop antennas are not coupled inductively, the currents that flow in adjacent antennas are in a sense orthogonal to each other. This permits each antenna loop-pair to be treated as a separate antenna (i.e. the loop antennas, while in close proximity to each other, are electrically isolated from each other). Thus, each loop antenna can be tuned to a different operating state, where operating state means any combination of terminal impedance, impressed amplitude, frequency, timing, phase or functionality, such as transmit or receive; and used in conjunction to support a signal having a broader bandwidth or to support completely independent signals in one antenna assembly.

In one embodiment, an antenna system comprises a system of loop antennas which include one or more sets of loop antennas. The loop antennas are configured to reduce (or ideally eliminate) near field inductive interaction between the loop antennas. The loops may be provided having any regular or irregular geometric shape (e.g. oval, circular, rectangular, square, triangular shapes).

As used herein a "loop antenna set" may comprise two (i.e. a pair) or more than two loop antennas. A loop antenna system (or more simply an "antenna system") may include multiple loop antenna sets (for example, multiple sets of two or more loop antennas for use in RFID and other systems).

Since the loop antennas are not inductively coupled, each antenna in the antenna system can be tuned to a different operating state. In this manner, the paired or multiple loop antennas can be used in combination to transmit and receive signals over a frequency bandwidth which is wider than a frequency bandwidth over which a single loop antenna can operate. In some exemplary embodiments of the concepts, systems, and techniques described herein, the antenna system may also support completely independent signals in a single antenna system, thus providing a frequency-independent means of multiplexing signals into an RF system.

It should be noted that reference is sometimes made herein to a loop antenna system having a particular number of loops. It should of course, be appreciated that a loop antenna system may be comprised of any number of loops and that one of ordinary skill in the art will appreciate how to select the particular number of loops to use in any particular application.

It should also be noted that reference is sometimes made herein to a loop antenna system having a particular shape or physical size. One of ordinary skill in the art will appreciate that the concepts and techniques described herein are applicable to various sizes and shapes of loops and/or arrays and that any number of loop antenna elements may be used and that one of ordinary skill in the art will appreciate how to select the particular sizes, shapes of number of loops to use in any particular application. It should also be appreciated that practical systems will typically utilize combinations of three sub-antennas in three layers. To provide systems having more than three layers an additional degree of freedom is required. Such an additional degree of freedom may be introduced, for example, by requiring loop triplets for each sub-antenna, such that the mutual coupling between ail subsets of antennas can be made to satisfy the necessary condition of summing the mutual contributions to zero.

Similarly, reference is sometimes made herein to a loop antenna having a particular geometric shape (e.g. square, rectangular, triangular, round) and/or size (e.g., a particular number of loop antenna elements) or a particular spacing or arrangement of loop antenna elements. One of ordinary skill in the art will appreciate that the techniques described herein are applicable to various sizes and shapes of loop antennas.

Thus, although the description provided herein below describes the inventive concepts in the context of one or more particular loop antenna systems, those of ordinary skill in the art will appreciate that the concepts equally apply to other sizes and shapes of loop antennas.

Also the concepts described herein in the context of loop antenna elements may find use in antenna elements implemented in a variety of manners including implemented as any type of printed circuit antenna or wire loop antenna (regardless of whether the element is a printed circuit element) known to those of ordinary skill in the art.

Referring now to FIG. 1, an antenna system 10 comprises a plurality of, here two, loop antenna sets 12, 14 with each antenna set comprising a plurality of, here two, respective loop antennas 12*a*, 12*b*, 14*a*, 14*b*. The four loops 12*a*, 12*b*, 14*a*, 14*b* are configured such that the near field inductive coupling between the set of loops 12*a*, 12*b* and 14*a*, 14*b* is zero. Specifically, this is achieved because the mutual coupling between loops 12*a* and 14*b*, 12*b* and 14*a*, and 12*b* and 14*b* is of the opposite sense as to that between 12*a* and 14*a*. Loop antennas 12*a*, 14*b* are disposed in a first plane and loop antennas 14*a*, 12*b* are disposed in a second, different parallel plane. Appropriately selecting the spacing, S between the two planes results in the sum of the mutual terms equaling zero.

Figure 9:
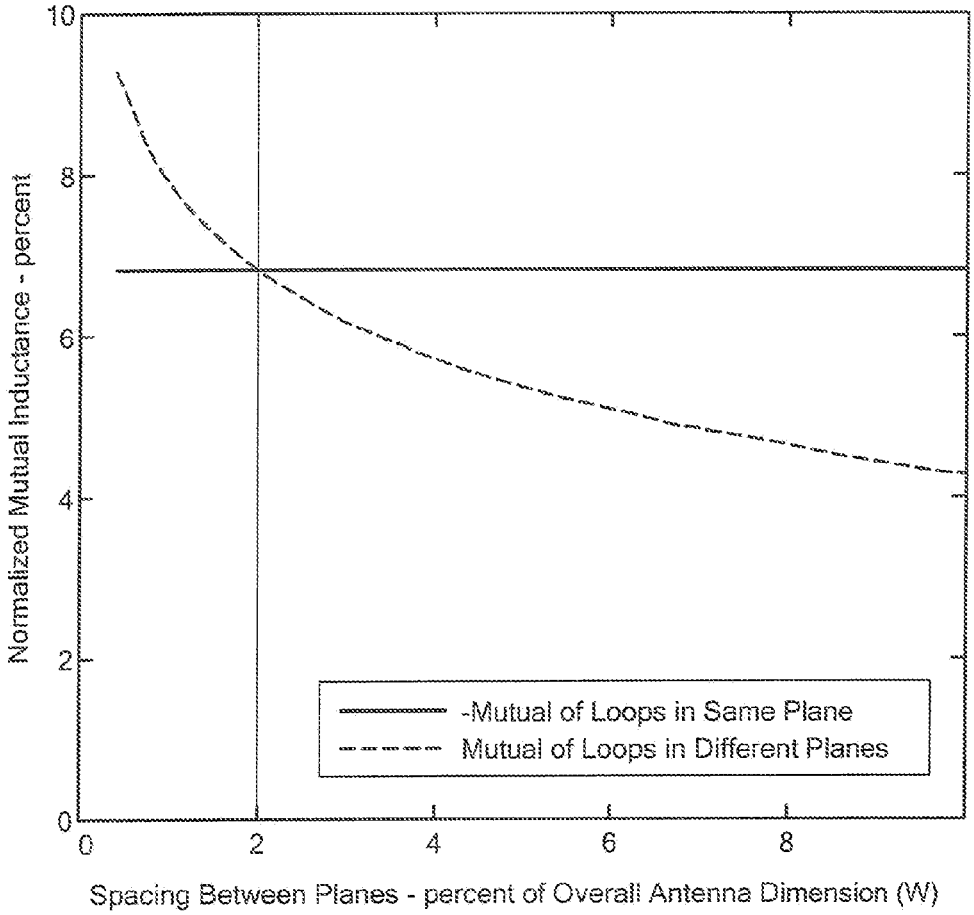
FIG. 9 is a plot of two normalized mutual inductance components of a two layer antenna having a square shape vs. spacing between loop layers as a percentage of overall antenna width.

The spacing, S, is determined by first selecting a mechanically achievable separation between the two co-planar loops and a ratio between the sizes of these two loops. The mutual inductance between the loops that are located in the same plane (one loop from each set of pairs) is computed using standard techniques and comparing it to the mutual inductance computed between the larger cons that are located in different planes as a function of the spacing between them Since the induced currents between these two condition have opposite senses, the spacing at which the currents have equal magnitudes defines the spacing that yields the desired isolation between the two pairs of loops. This is illustrated for the antenna system 10 of FIG. 1 in FIG. 9. The figure plots the in-plane and between-plane mutual inductances, normalized to the self inductance of a single turn loop of comparable outer dimensions, as a function of the spacing between the loops as a percentage of the width of the antenna system. The spacing at which the two mutual inductances are equal constitutes the appropriate spacing to achieve isolation between the two loop pairs.

Figure 10:
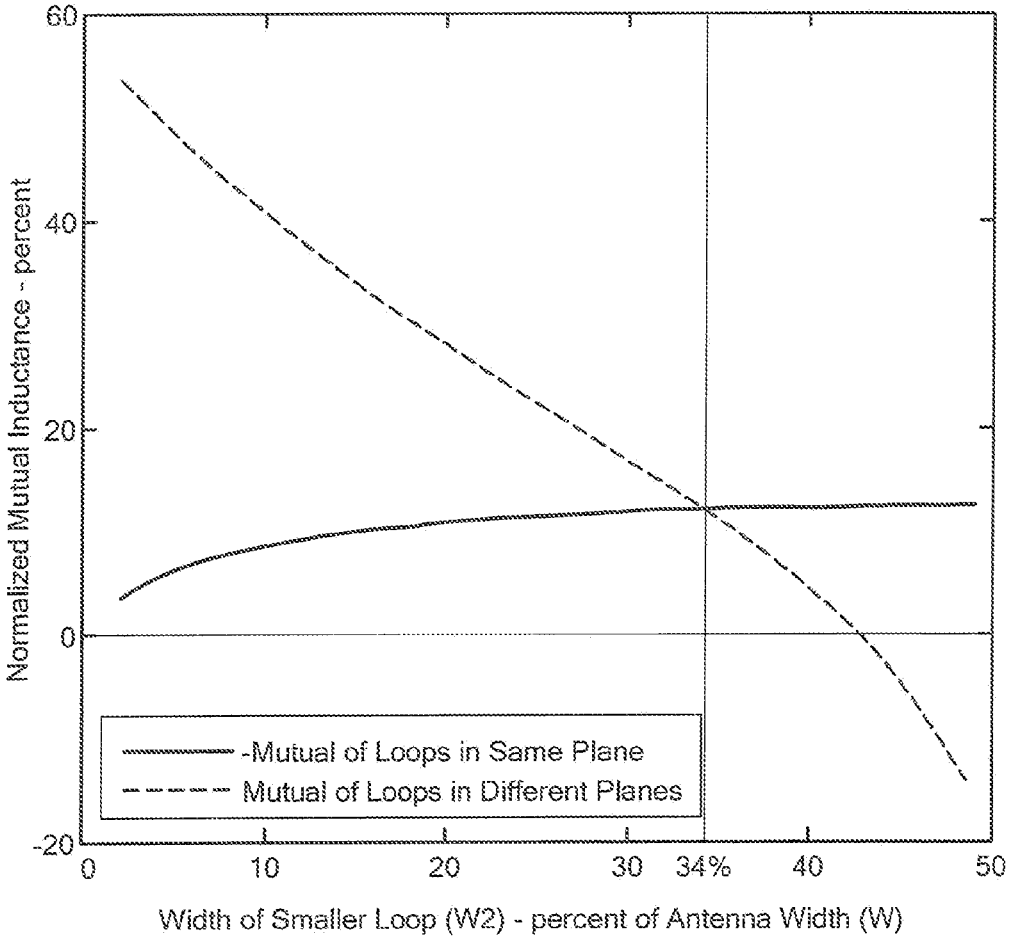
FIG. 10 is a plot of normalized mutual inductance components of a two layer antenna having a circular shape vs. width of the smallest loop as a percentage of overall antenna width.

An appropriate ratio for the individual sizes of the two loops situated in the same plane (layer) is determined for a desired spacing between the planes is determined by the ratio at which the two component mutual inductances are equal. FIG. 10 plots the normalized mutual inductances for the antenna system 10 of FIG. 1 for a spacing between the two layers of two percent of the width of the antenna system. The point at which the values of the two are equal defines the ratio required to produce the desired isolation between loop pairs at the specified spacing between the loop planes. It is assumed that a means of making final adjustments to this spacing is also provided in the construction of the antenna system to compensate for tolerances in the computations and manufacture of the antenna system.

In addition, the individual loops in each loop pair, 12*a*, 12*b* and 14*a*, 14*b*, are positioned such that the fields created by the presence of their currents outside of the volume that contains the antenna elements add together. Therefore, energy introduced into loop 12*a* adds to the energy in loop 12*b* and the energy in loop 14*a* adds to the energy in loop 14*b*. Furthermore, because the two loop pairs 12, 14 are not coupled inductively, the currents that flow in each pair are in a sense orthogonal to each other. This current orthogonality means that the impedances of the two pairs are isolated one from the other, which allows each of them to be tuned (or matched) to a different frequency without impacting the tune or match of the other.

When the two sets of loops are properly sized, the spacing S required between them to achieve isolation becomes small. Careful design can reduce this spacing to less than one percent of the major dimensions of the loops. For example, while symmetry is not strictly required, it can simplify the design process. Selection of the gap between loop pairs/triplets, the ratio of the smaller to the larger loops and the spacing between loop planes. The size of the gap between loops places a fundamental limit on how close the loops can be and still achieve isolation. In some geometry cases, such as the use of the round concentric loop geometry, the ratio between the smallest and largest loop can also place a limit on the spacing. When loops are placed too close together, the mutual coupling between loops in different planes can become greater than the achievable coupling between loops in the same plane. In such a case, isolation cannot be created, regardless of the inter-plane spacing or inter-loop gap. Avoiding such condition constitutes a 'careful design'.

If, in turn, the two sets of tuned antennas are then connected in series or parallel and fed (by conventional means) e.g. well known "L-network" techniques to establish the tuned conditions incorporated herein.] from a signal source, the joint antenna can be made to efficiently support a wider bandwidth than the sum of the two antennas taken separately. Analysis has shown this increase to be as much as 3.5 times that of a single antenna of the same size. Consider that each loop has a tuning network that has a first and a second terminal; a series condition is achieved by connecting the second terminal of the first antenna to the first terminal of the second antenna and the second terminal of the second antenna is connected to the first terminal of the third, if a third antenna is used. The first terminal of the first antenna and the second terminal of the last antenna comprise the two input terminals to the composite antenna. The parallel connection is achieved by connecting all of the first terminals of the various individual tuned loops together and all of the second terminals together. The composite first and second terminals constitute the input terminals of the antenna in this case.

Figure 2:
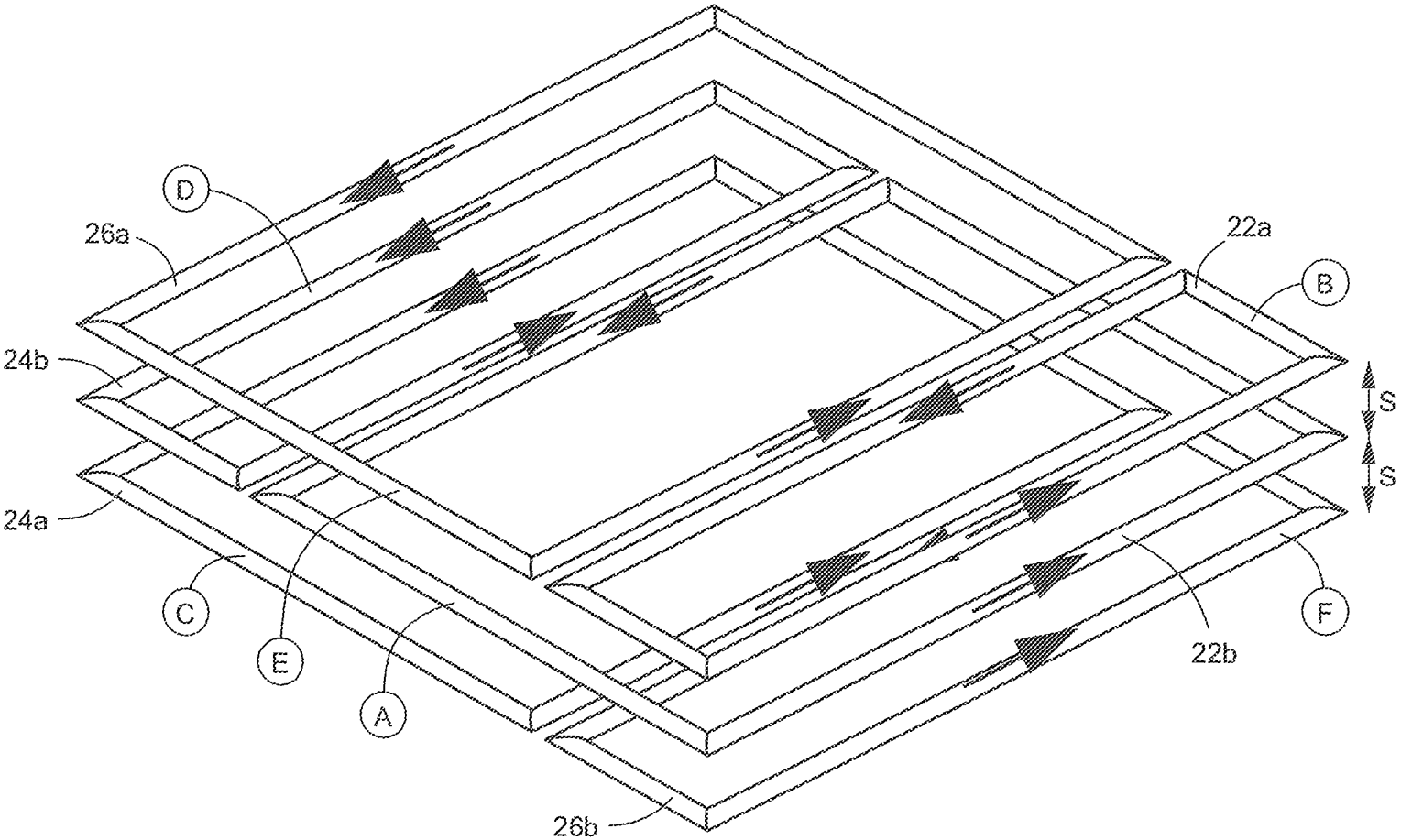
FIG. 2 is a diagram of a three-layer orthogonal loop antenna, according to one embodiment of the present invention.

Referring now to FIG. 2 an antenna system comprises three pairs of loops configured to provide three sets 22, 24, 26 of orthogonal loop antennas, 22*a*-22*b*, 24*a*-24*b*, 26*a*-26*b*. Such a configuration has the potential of providing a bandwidth-efficiency product that is as much as 4.5 times that of a comparable single loop or of a conventional, three turn loop. In the antenna system 20, loop antennas 22*a*-26*a* are in a first plane, loop antenna 22*b*-24*b* are in a second plane which is parallel to and spaced apart from the first plane by a distance S1 and loop antennas 24*a*-26*b* are in a third plane which is parallel to and spaced apart from the second plane by a distance S2. The distances S1, S2 may or may not be equal. In practical systems, the spacing would need to be different if the width ratio of 26*a* to 22*a*, for example, was different than that of 24*a* and 26*b*. They would also need to be different if the gap between in-plane loops was not uniform. The spacings S2 are selected to reduce and ideally eliminate mutual coupling between the loop antennas (La the mutual coupling terms sum to zero).

It should be appreciated that, and as will become apparent from the additional embodiments described herein below, these are not the only configurations of loops that can provide the ability to isolate closely spaced loops such that they can be combined to provide increased bandwidth.

Figure 3:
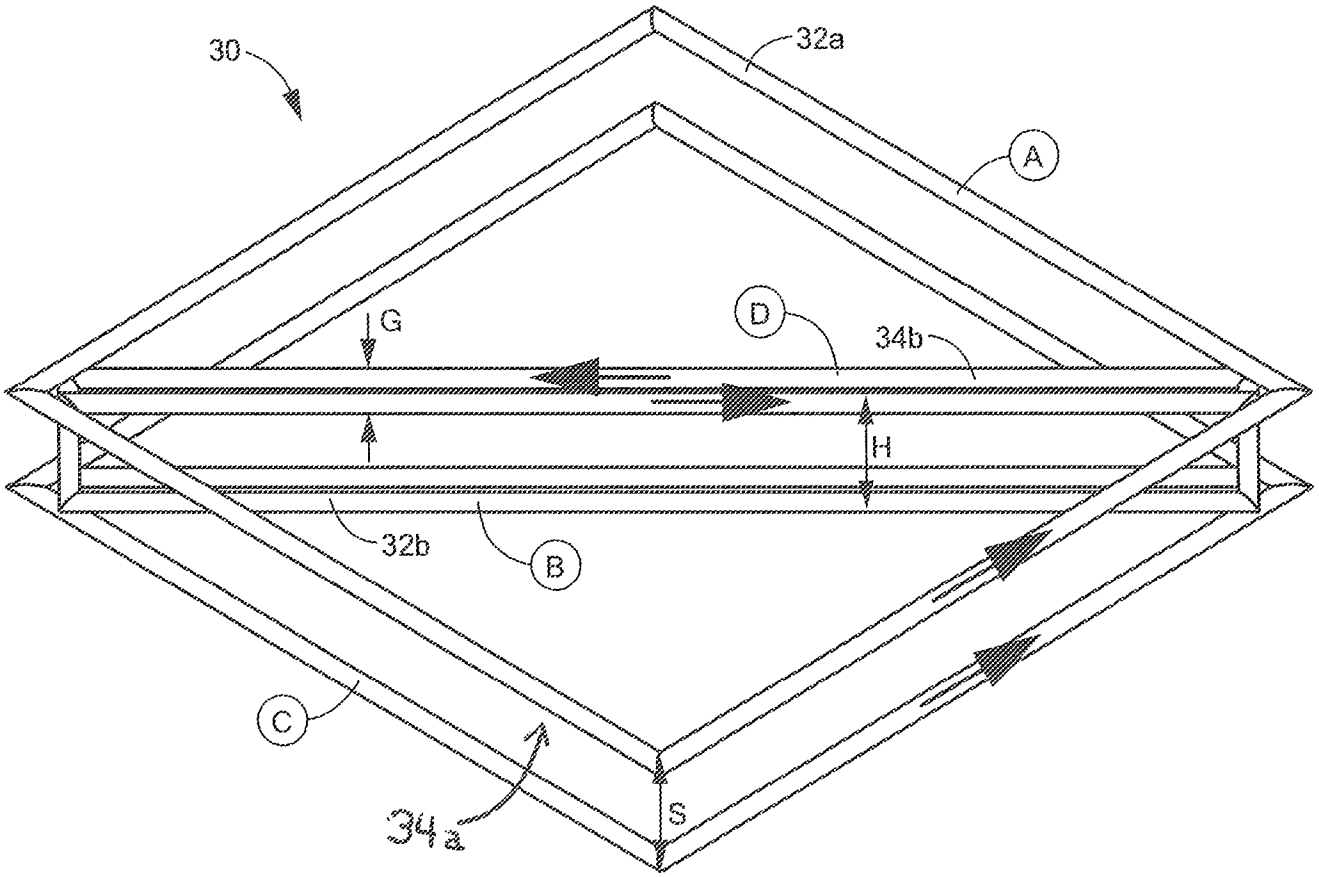
FIG. 3 is a diagram of an antenna system provided from two pairs of square-shaped loop antenna disposed in two parallel planes with a pair of spaced-apart rectangular-shaped loop antennas disposed in a space between the two planes.

Referring now to FIG. 3, an antenna system 30 comprises two vertically-oriented loops 32*b* and 34*b* which are smaller than loops 32*a* and 32*c*, but are spaced closer together than loops 32*a* and 34*a*. In addition, the current sense is reversed in loop 34*b* relative to loop 32*b*. Again, orthogonality is enforced by selecting the sizes of the loops, and their spacing, such that the sum of the mutual inductance between the two sets of loops, 32*a*-32*b* and 34*a*-34*b*, is zero. The sizes and spacing of loops 32*b* and 34*b* are selected such that the mutual inductance between the loops is equal to that between loops 32*a* and 34*a*. This can be done by adjusting the height of 32*b* and 34*b* for a given value of the space between them. Or, the height can be selected and the spacing determined by computation to satisfy the necessary condition that the mutual inductance between 32*b* and 34*b* be identical to that between 32*a* and 34*a*. Fine tuning of this balance of the mutual components can be achieved after fabrication by making provisions to either adjusting the spacing between loops 32*b* and 34*b* or by adjusting the space between 32*a* and 34*a*.

It should be noted that though all of these loops are orthogonal from the standpoint of their feed point impedances, the fields created around the loops are additive.

Figure 4:
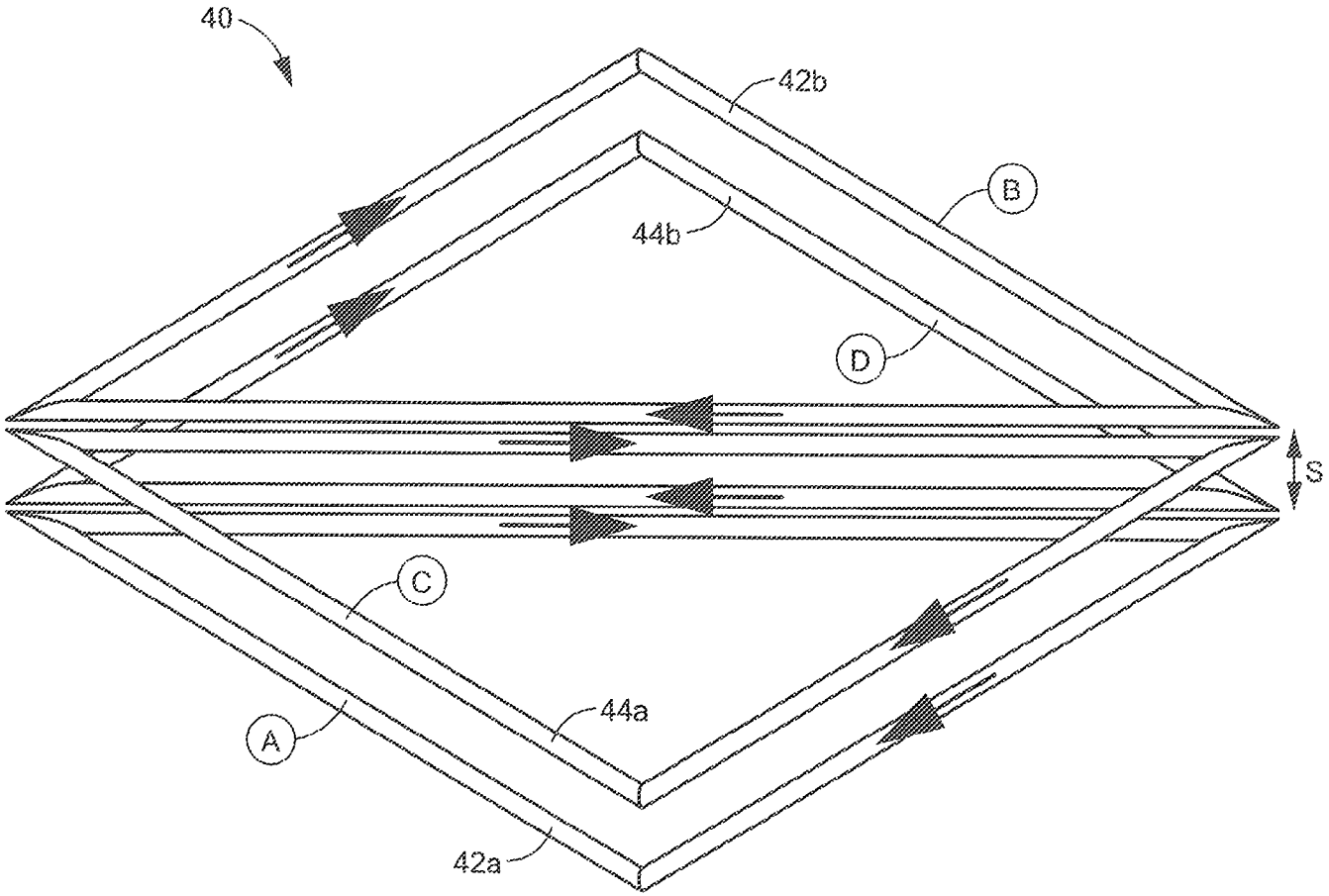
FIG. 4 is a diagram of a two layer orthogonal loop antenna with each loop having a triangular shape.

Referring now to FIG. 4, an antenna system 40 illustrates another alternate loop configuration that achieves the desired orthogonal current relationship between two sets of loops. Antenna system 40 comprises a plurality of loop antennas with each antenna having a triangular shape. In this embodiment, a first set of loops comprises loops 42*a*, 42*b* and a second set of loops comprises loops 44*a*, 44*b*.

Figure 5:
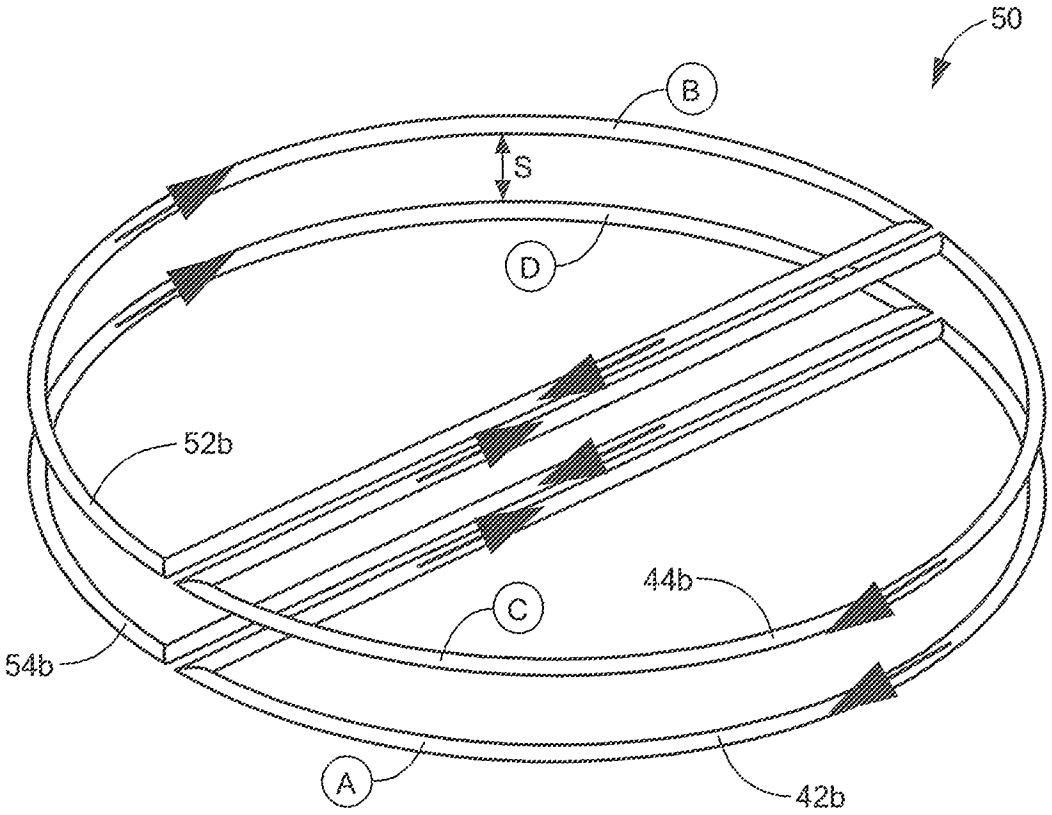
FIG. 5 is a diagram of a two layer orthogonal loop antenna with each loop having a semi-circular shape.

Referring now to FIG. 5, antenna system 50 comprises a plurality of loop antennas with each antenna have a semi-circular shape. In this exemplary embodiment, a first set of loops comprises loop 52*a*, 52*b* and a second set of loops comprises loops 54*a*, 54*b*.

Figure 6:
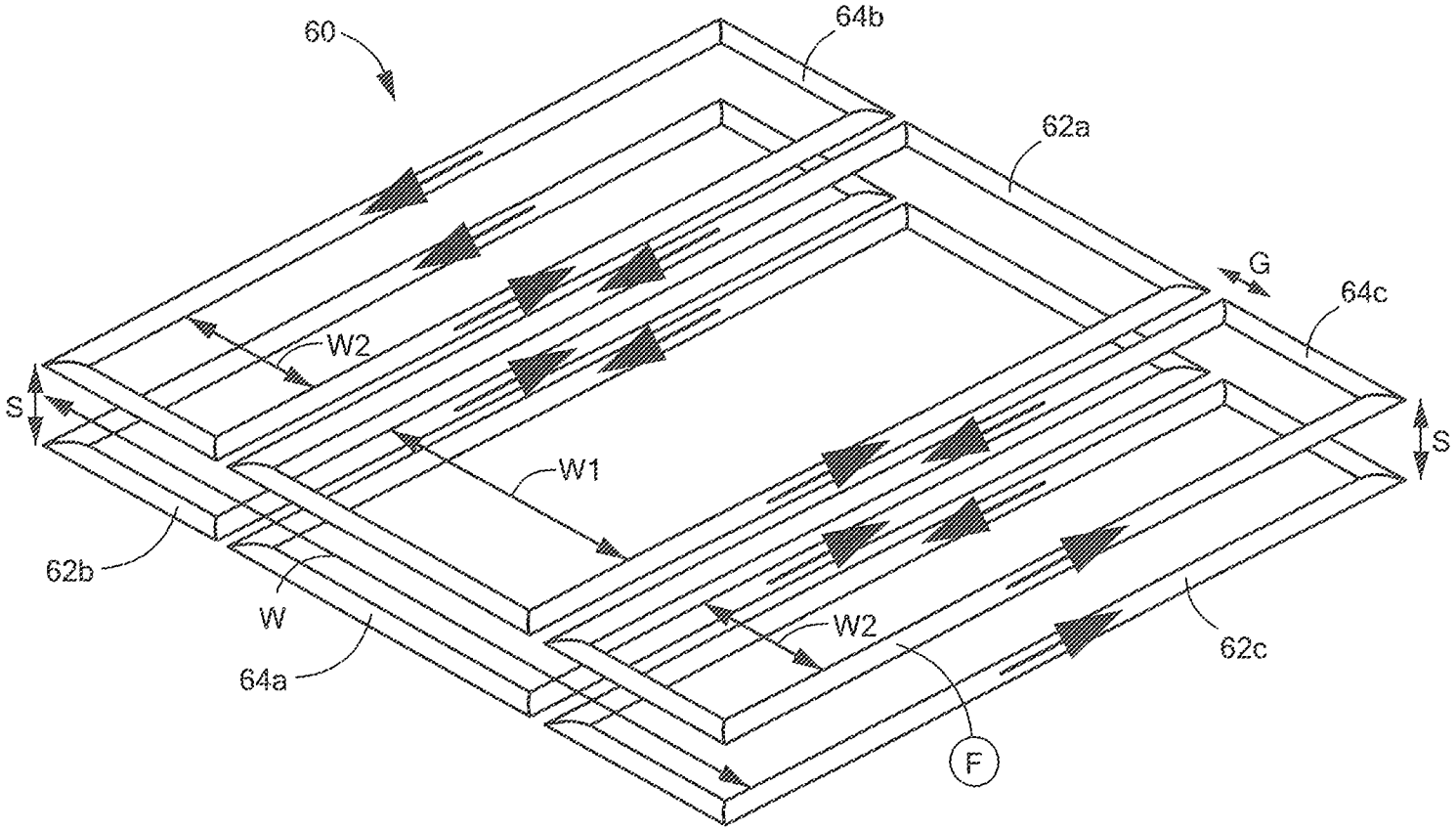
FIG. 6 is a diagram of an alternate embodiment of a two layer orthogonal loop antenna with each loop set comprising three loops having rectangular shapes.

Referring now to FIG. 6, antenna system 60 comprises a plurality of loop antennas with each antenna have a rectangular shape. In this exemplary embodiment, a first set of loops comprises loop 62*a*, 62*b*, 62*c* and a second set of loops comprises loops 64*a*, 64*b*, 64*c*. This configuration achieves a greater degree of sub-antenna symmetry by spiting into three smaller loops and placing each of the smallest loops on either side of the larger loop from the opposite sub-antenna.

Figure 7:
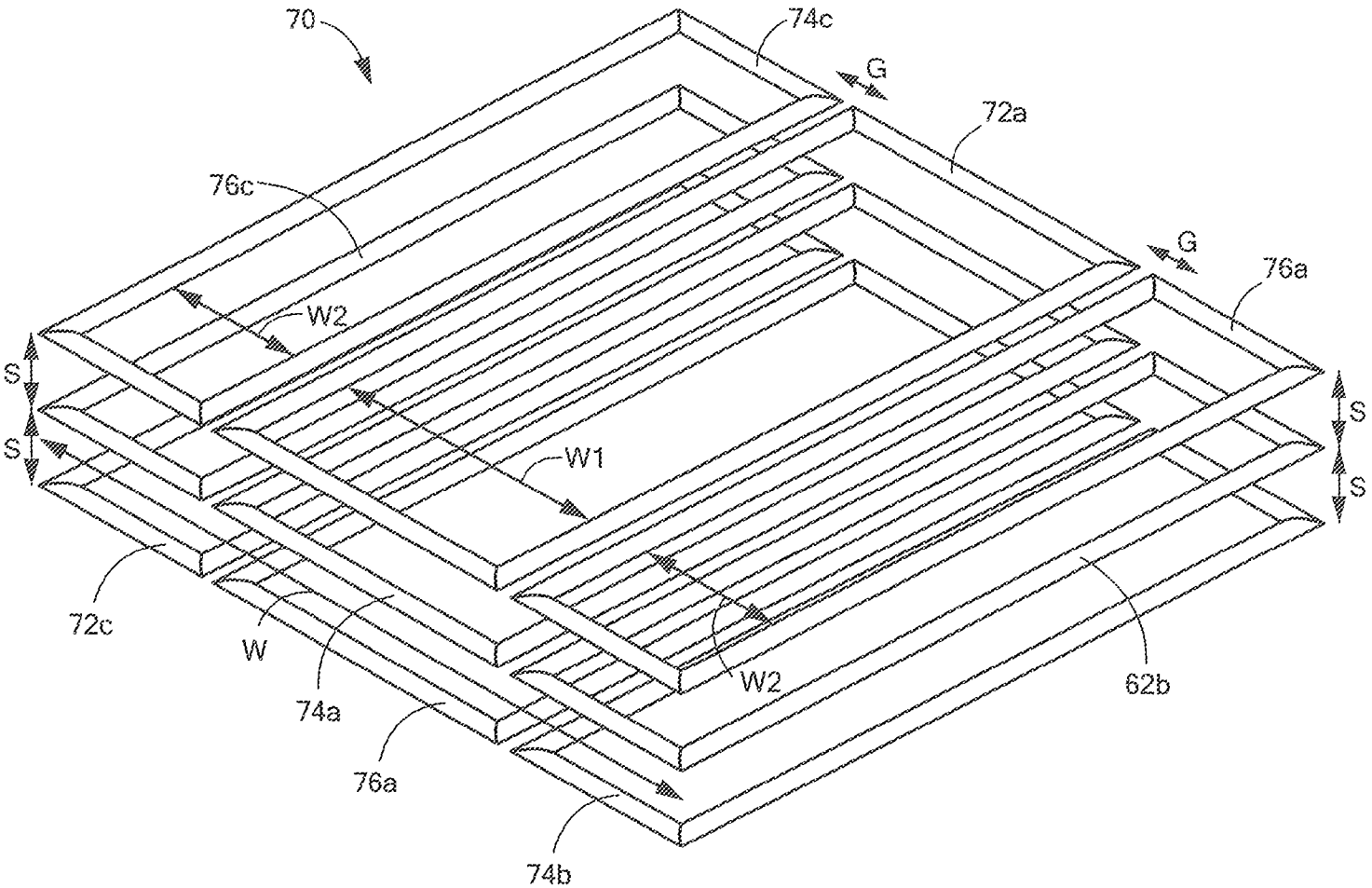
FIG. 7 is a diagram of a three layer orthogonal loop antenna with each loop set comprising three loops having rectangular shapes.

Referring now to FIG. 7, antenna system 70 comprises a plurality of loop antennas with each antenna have a rectangular shape. In this exemplary embodiment, a first set of loops comprises loop 72*a*, 72*b*, 72*c*; a second set of loops comprises loops 74*a*, 74*b*, 74*c* and a third set of loops comprises loops 76*a*, 76*b*, 76*c*. One loop of the sub-antenna triplet occupies a place within each of the three layers (planes) that compose the entire antenna system.

Figure 8:
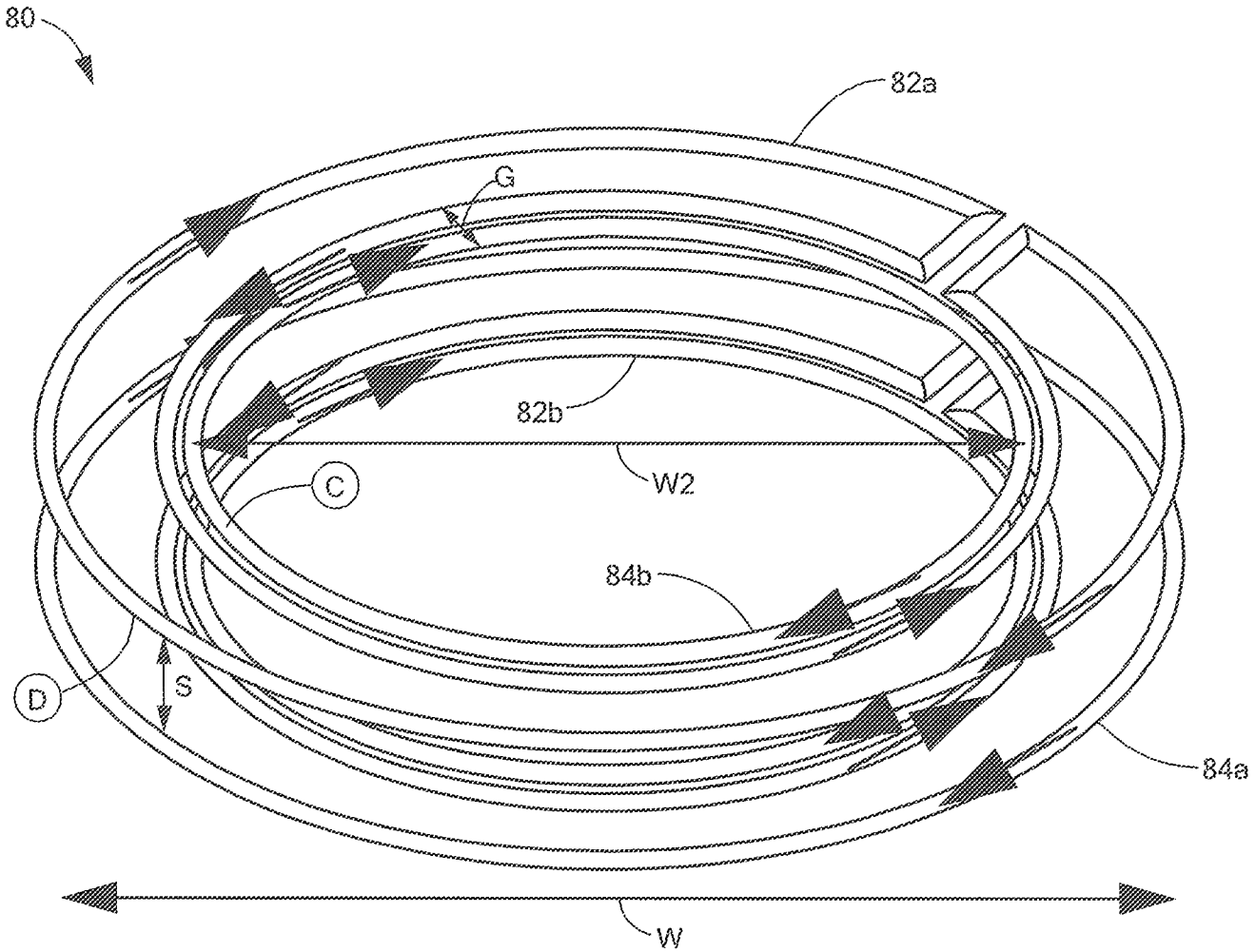
FIG. 8 is a diagram of a two layer orthogonal loop antenna with each loop set comprising three concentric loops each having a circular shape.

Referring now to FIG. 8, antenna system 80 comprises a plurality of loop antennas with each antenna have a circular shape. In this embodiment, a first set of loops comprises loop 82*a*, 82*b* and a second set of loops comprises loops 84*a*, 84*b*. The loops 82*a* and 84*a* each include two concentric circular conductors connected in series, the inner conductor is sized to enclose the loop 84*b* and placed as close as is practical to loop 84*b*.

Figure 11:
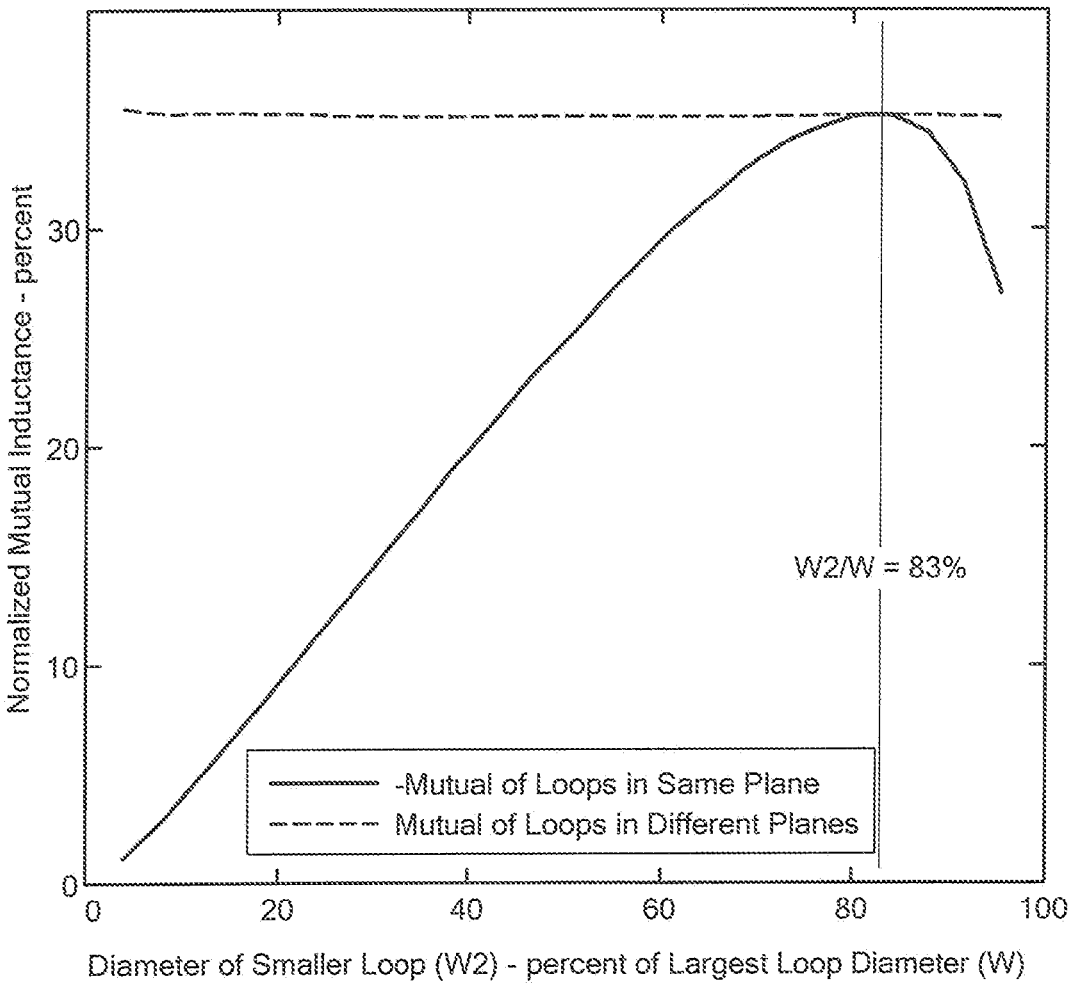
FIG. 11 is a plot of normalized mutual inductance components of a two layer antenna having a circular shape vs. diameter of the smallest loop as a percentage of overall antenna width for a spacing between layers of 3.5 percent.

FIG. 11 is a plot of normalized mutual components computed for the antenna system 80 vs. the diameter of an inner loop as a percentage of the outer diameter of the antenna system for a spacing between the loops of 3.5 percent of the outer diameter of the antenna system. It is seen that the two components are equal where the ratio between the inner and outer loop diameters is 83 percent.

Figure 12:
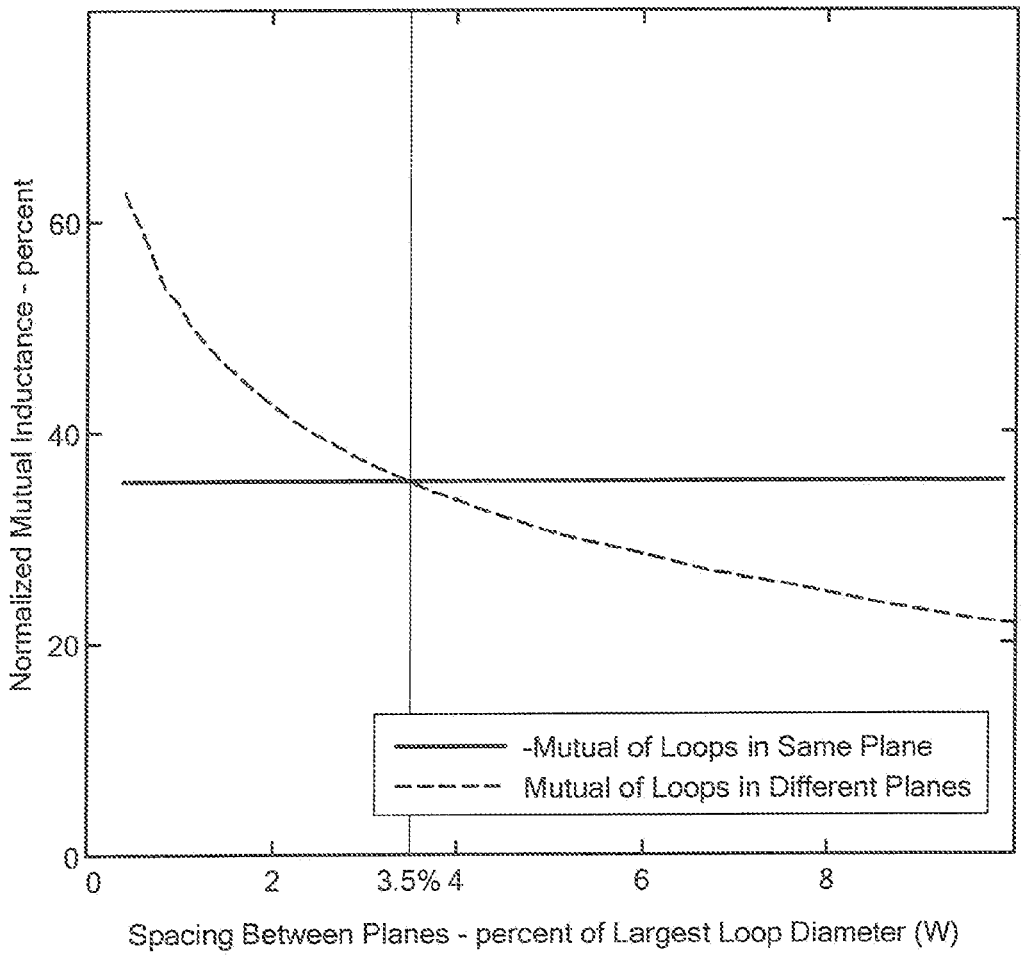
FIG. 12 is a plot of normalized mutual inductance components of a two layer antenna having a circular shape vs. spacing between layers as a percentage of overall antenna width for a ratio of smallest to largest loop equal to 83 percent.

FIG. 12 is a plot of normalized mutual components computed for the antenna system 80 vs. the spacing between the layers as a percentage of the outer diameter of the antenna system for a ratio between the inner and outer loop diameters of 83 percent for a system. It is seen that the two components are equal where the spacing between the loops is 3.5 percent of the outer diameter of the antenna.

One of ordinary skill in the art will readily appreciate that still further loop configurations not otherwise described herein may also be used. Accordingly, the present concepts, systems, and techniques are not to be construed as limited to the geometries shown and described herein.

Rather, it should now be appreciated and understood, that by using geometric relationships between loop antennas, the concepts, systems, and techniques disclosed herein provide a frequency-independent means of multiplexing signals onto an antenna. The input signals may be at different or overlapping frequencies, as desired, yet no prohibited band is present as there is in conventional diplexers or triplexers.

As an illustration of the performance of one representative embodiment of the present concepts, systems, and techniques, an analysis was performed for a typical application of an electrically small loop, a 12-inch square antenna, at 30 MHz. The loop is eleven (11) degrees across at the selected 30 MHz frequency. Although a 12-inch square antenna operating at 30 MHz is described in the context of this analysis, those of ordinary skill in the art will realize that other antenna sizes, dimensions, and operating frequencies may also be used. Accordingly, the concepts, systems, and techniques described herein are not limited to any particular antenna sizes, dimensions, and operating frequencies.

The Chou limit bandwidth for such an antenna is found using Eqn. 2:

$$\frac{f_i}{Q_{chom}(f_i, a_{eff}, 1)} = 37.483 \text{ kHz}$$

where $f_t$ is the test frequency, $a_{eff}$ is an effective radius of the antenna, that is the radius of a circle having the same area as the square loop and the function in the denominator is the Chou limit, which is a commonly used measure for small antennas. The Chou limit defines the minimum quality factor, or Q, that can be achieved for an electrically small antenna of a given volume and is given by Eqn. 3:

$$Q_{chou}(f, a, \eta) := \eta \cdot \left[\frac{1}{(k(f) \cdot a)^3} + \frac{1}{k(f) \cdot a}\right]$$

where k(f) is the propagation constant $2\pi/\lambda$, $\eta$ is the efficiency of the antenna, taken here to be 100% and $\lambda$ is the wavelength at the test frequency. Note that the bandwidth is quite small, at just ⅛th of a percent of the test frequency.

A practical example of this loop was built using a conductor of 0.140 inch diameter on two 12 by 12 inch plastic frames (other physical structures are of course useable, without limitation). The loops were sized to achieve the desired orthogonal current relationship at a spacing between the layers of about ½ inch, according to calculations of the mutual inductances. A network analyzer was used to measure the coupling, S21, which was found to be maximized at the predicted spacing. The achieved isolation was on the order of 50 dB across a wide band. That is, it was substantially independent of frequency, as expected.

Figure 13:
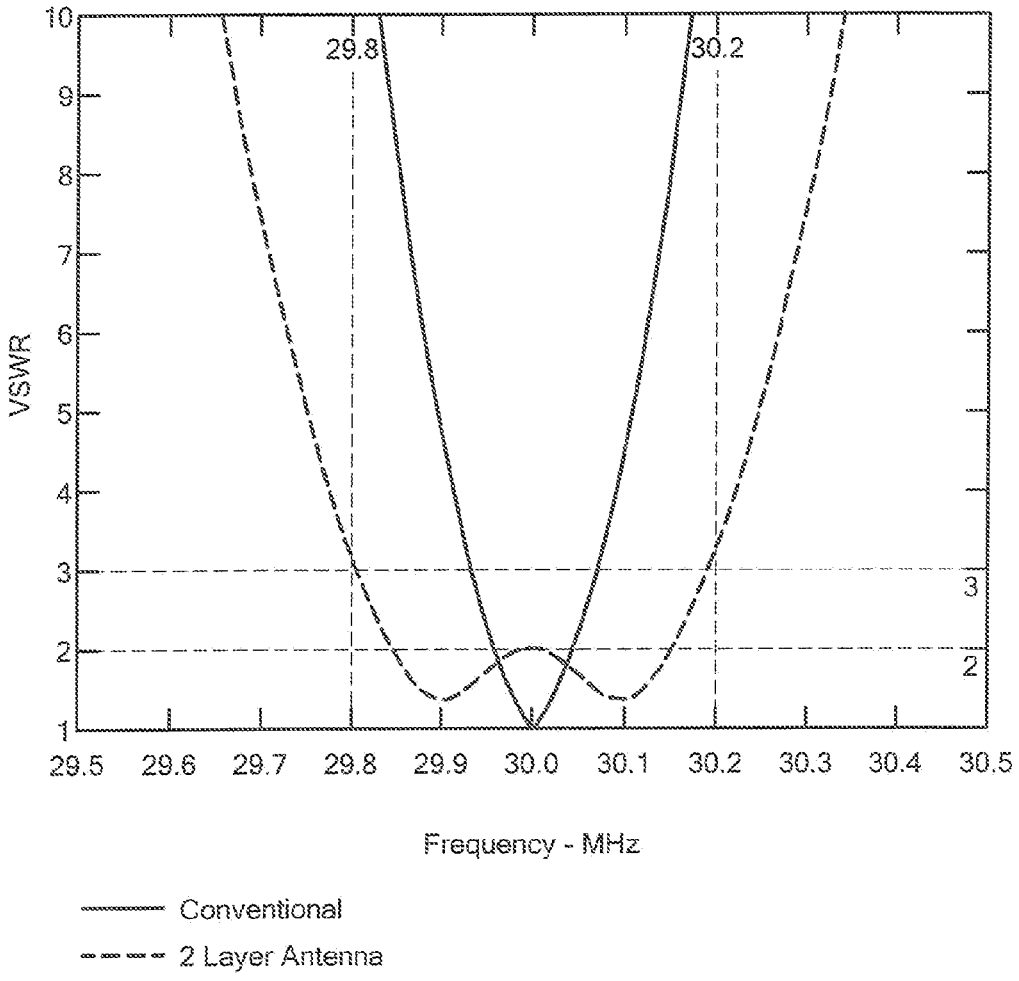
FIG. 13 is a plot of Voltage Standing Wave Ratios (VSWRs) vs. frequency for conventional and two layer orthogonal loop antennas.
Figure 14:
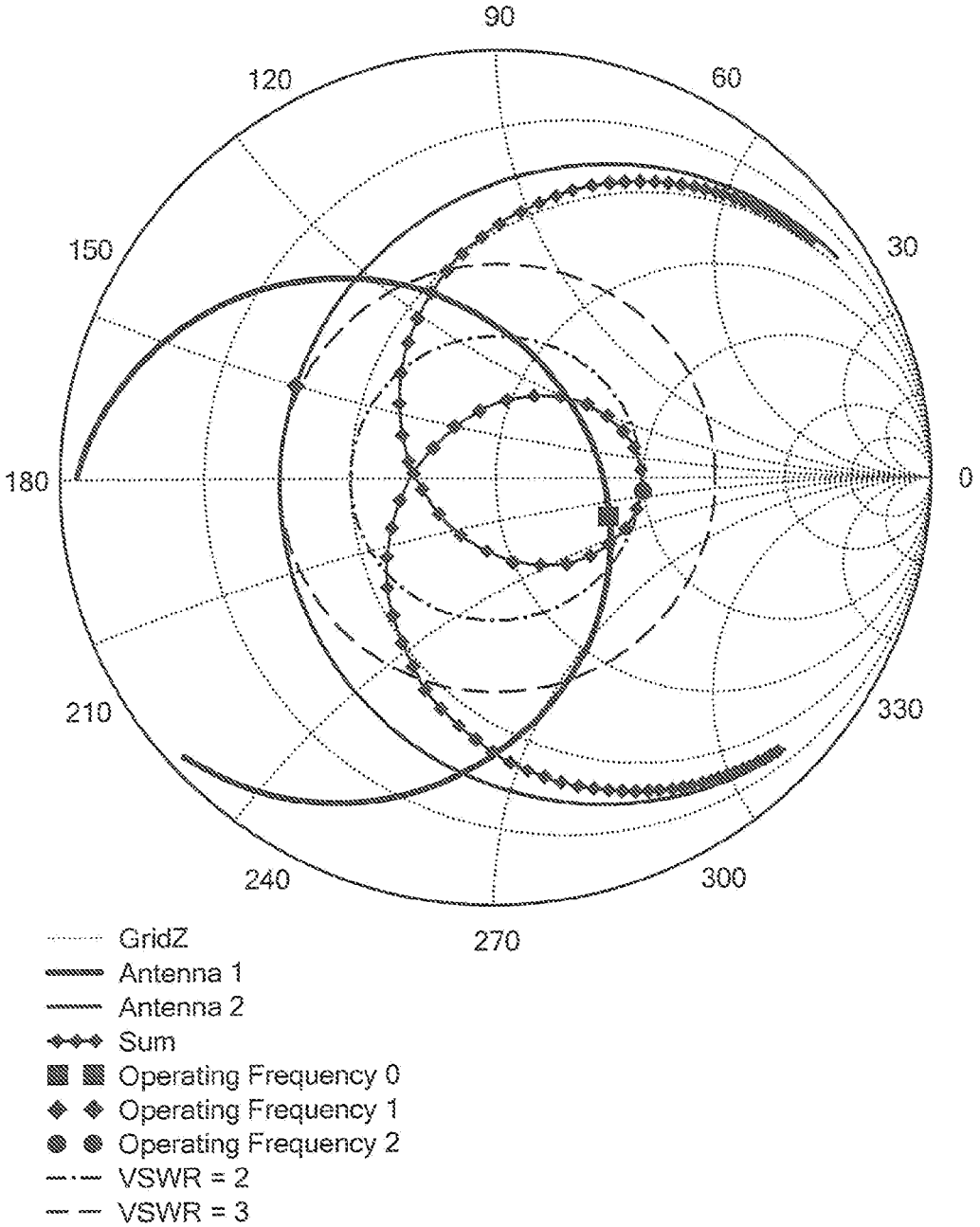
FIG. 14 is a Smith chart plot of impedance as function of frequency in a two-layer orthogonal loop antenna constructed according to one embodiment of the present invention.

Calculations were also performed to estimate the achievable bandwidth for two and three layered configurations when properly tuned and matched. The Q of the loops was taken to be 250, which is judged to be practical. The tuning and matching components were chosen to limit the in-band SWR to less than 2, except at the band edges, where the bandwidth was taken to be defined by a SWR of 3. The VSWE and impedances of the two independent loops and the composite of the two connected in series are shown in FIGS. 13 and 14.

The two antennas were intentionally tuned to provide resonances of the opposite types; one exhibiting an RLC series resonance and the other an RLC parallel resonance. In this way, the reactance of one antenna at least partially cancels the reactance of the other. This leads to the large bandwidth expansion.

Figure 15:
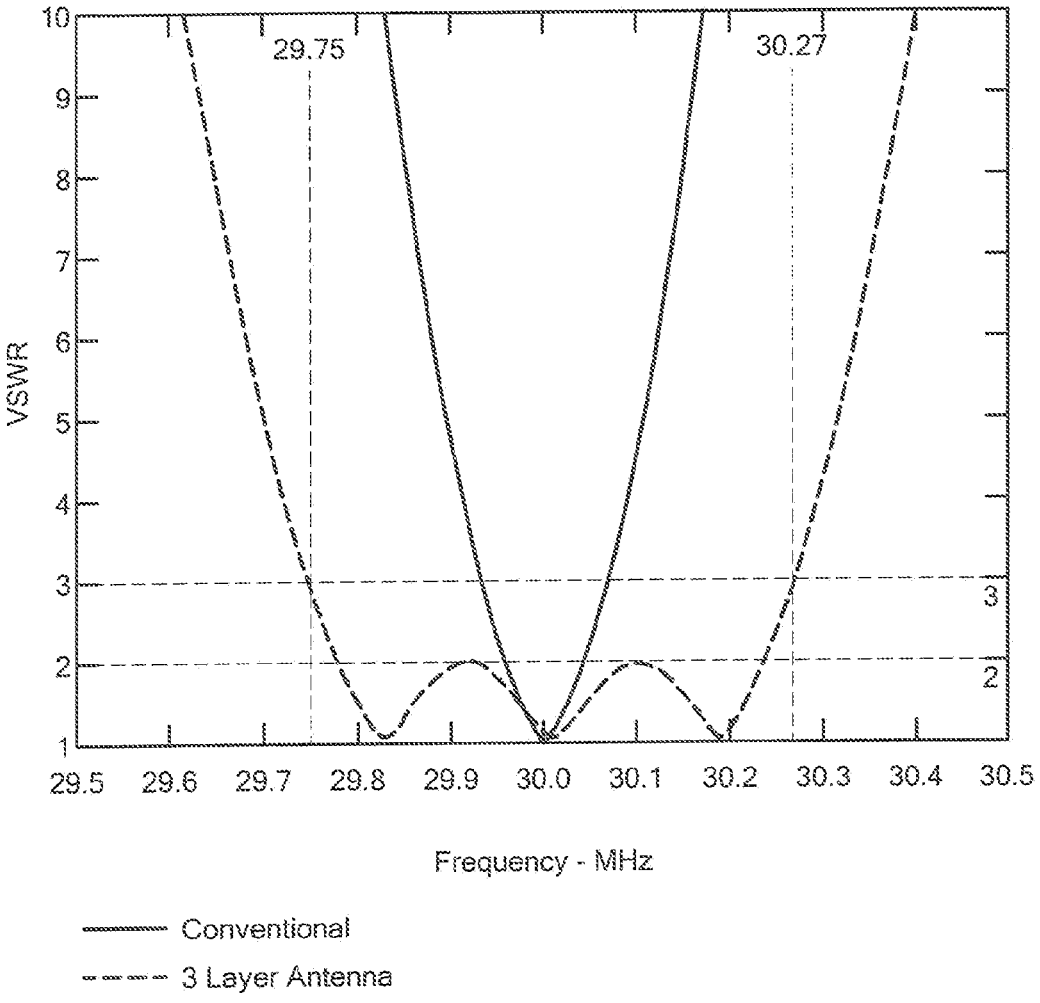
FIG. 15 is a graph of VSWR vs. frequency for conventional and three layer orthogonal loop antennas.
Figure 16:
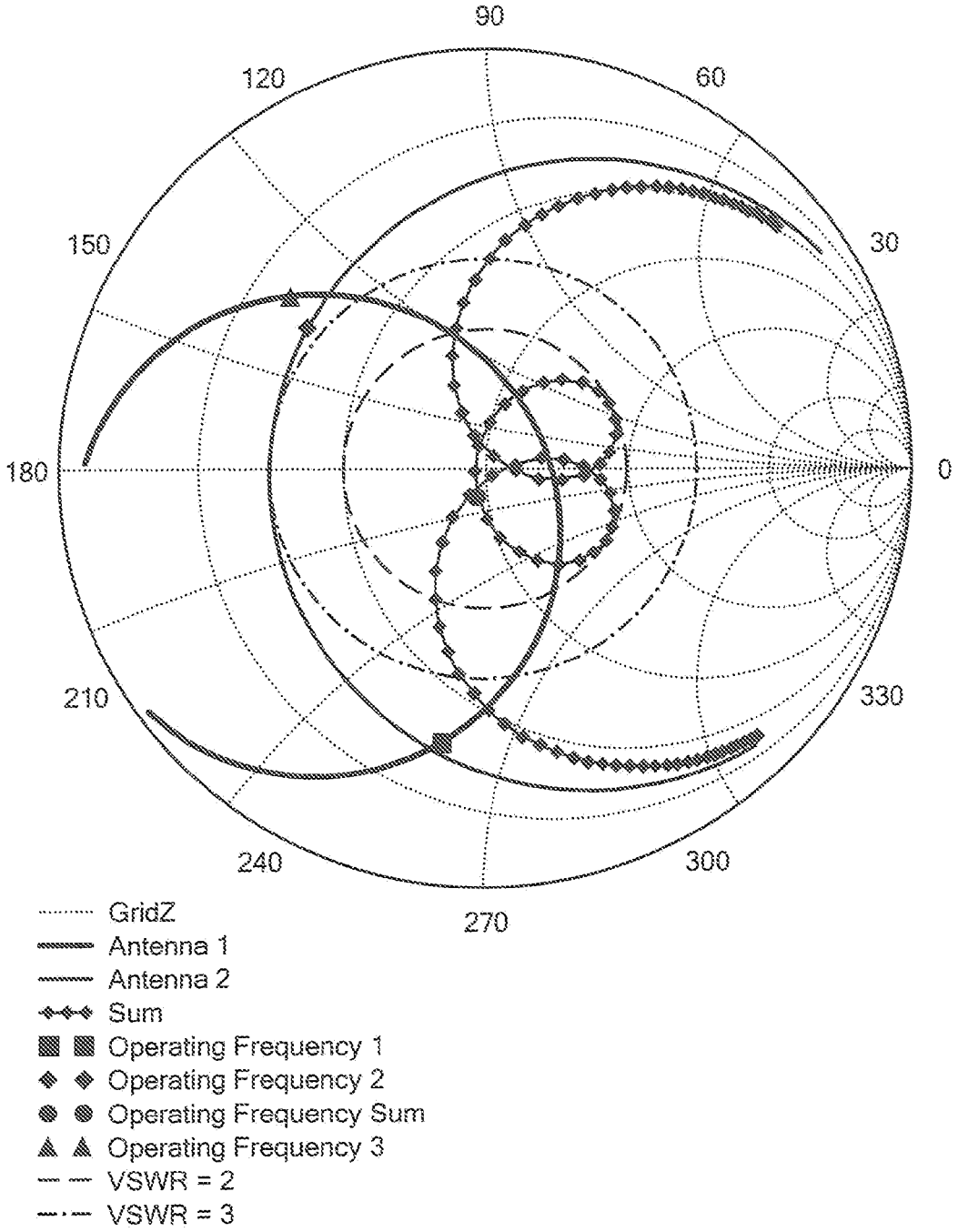
FIG. 16 is a Smith chart plot of composite impedance as function of frequency in a three-layer orthogonal loop antenna constructed according to one embodiment of the present invention.

Extrapolating this approach to three antenna layers yields the SWR response shown in FIG. 15 while FIG. 16 shows composite impedance plot for this antenna configuration. The bandwidth expansion for this configuration is a factor of 4.3, bringing the antenna's bandwidth to about 85% of the Chou limit value.

While particular embodiments of the present invention have been shown and described, it will be apparent to those skilled in the art that various changes and modifications in form and details may be made therein without departing from the spirit and scope of the invention as defined by the following cams. Accordingly, the appended claims encompass within their scope all such changes and modifications.

I claim:

1. An antenna system comprising:

a plurality of pairs of individual-loop antennas with each of the plurality of pairs of individual-loop antennas disposed in different parallel planes, wherein a first pair of individual-loop antennas is disposed in a first plane and a second pair of individual-loop antennas is disposed in a second plane with each of the planes being spaced apart from another adjacent plane and wherein said plurality of individual-loop antenna pairs are disposed to form a plurality of individual-loop antenna sets, wherein said plurality of individual-loop antenna pairs are configured such that the near field inductive coupling between the plurality of individual-loop antenna sets is zero, and wherein the plurality of individual-loop antenna sets are coupled in series or in parallel.

2. The antenna system of claim 1 wherein the individual-loop antennas in each of said plurality of individual-loop antenna sets are coupled such that their currents add together.

3. The antenna system of claim 1 further comprising a signal source coupled to feed said series coupled individual-loop antenna sets.

4. The antenna system of claim 1 further comprising a signal source coupled to feed said parallel coupled individual-loop antenna sets.

5. The antenna system of claim 1 wherein the individual-loop antennas are provided having a shape corresponding to one of:

a rectangular shape;
a triangular shape;
a semi-circular shape;
a square shape; and
a semi-oval shape.

6. An antenna system comprising:

a four individual-loop antenna with a first group of two individual-loop antennas disposed in a first plane and a second group of two individual-loop antennas disposed in a second different plane which is parallel to and spaced apart from the first plane by a distance S1 and wherein a first pair of individual-loop antennas of said four individual-loop antenna forms a first individual-loop antenna set and a second pair of individual-loop antennas of said four individual-loop antenna form a second individual-loop antenna set, wherein the spacing between the first plane and second plane and a configuration of said four loop antenna are selected such that the near field inductive coupling between the first individual-loop antenna set and the second individual-loop antenna set is substantially zero, and wherein the first and second individual-loop antenna sets are coupled in series or in parallel.

7. The antenna system of claim 6 wherein a first individual-loop antenna of the first pair of individual-loop antennas which forms the first individual-loop antenna set is disposed in the first plane and a second individual-loop antenna of the first pair of individual-loop antennas which forms the first loop antenna set is disposed in the second plane.

8. The antenna system of claim 6 wherein the individual-loop antennas in each individual-loop antenna set are coupled such that their currents add together.

9. The antenna system of claim 6 further comprising a signal source coupled to feed said series coupled first and second individual-loop antenna sets.

10. The antenna system of claim 6 further comprising a signal source coupled to feed said parallel coupled first and second individual-loop antenna sets.

11. The antenna system of claim 6 wherein said each of the individual-loop antennas are provided having a shape corresponding to one of:

a rectangular shape;
a triangular shape;
a semi-circular shape;
a square shape; and
a semi-oval shape.

12. The antenna system of claim 6 further comprising a fifth individual-loop antennas and a sixth individual-loop antennas disposed in a third different plane which is below and parallel to the second plane and spaced apart from the second plane by a distance S2 and wherein a first pair of said sixth individual-loop antennas forms the first individual-loop antenna set, a second pair of said sixth individual-loop antenna forms the second individual-loop antenna set and a third pair of said sixth individual-loop antennas forms a third individual-loop antenna set wherein the spacings S1 and S2 and a configuration of said sixth individual-loop antennas are selected such that the near field inductive coupling between the first, second and third individual-loop antenna sets the is substantially zero.

13. The antenna system of claim 12 wherein:

a first individual-loop antenna of the first pair of individual-loop antennas which forms the first individual-loop antenna set is disposed in the first plane and a second individual-loop antenna of the first pair of individual-loop antennas which forms the first individual-loop antenna set is disposed in the third plane;

a first individual-loop antenna of the second pair of individual-loop antennas which forms the second individual-loop antenna set is disposed in the second plane and a second individual-loop antenna of the second pair of individual-loop antennas which forms the second individual-loop antenna set is disposed in the third plane; and a first individual-loop antenna of the third pair of loop antennas which forms the third individual-loop antenna set is disposed in the first plane and a second individual-loop antenna of the third pair of the sixth individual-loop antennas which forms the third individual-loop antenna set is disposed in the second plane.

14. An antenna system comprising:

a first individual-loop antenna disposed in a first plane, wherein the first individual-loop antenna is a first one of a plurality of individual-loop antennas disposed in the first plane;

a second individual-loop antenna disposed in a second plane that is different from the first plane, wherein the second plane is parallel to the first plane with each of the planes being spaced apart from each other;

a third individual-loop antenna disposed in a third plane, with the third plane being orthogonal to the direction of the first and second planes; and a fourth individual-loop antenna disposed in a fourth plane parallel to the third plane, wherein said first, second, third and fourth individual-loop antennas are configured such that the near field inductive coupling between each of the first, second, third and fourth individual-loop antennas is zero.

15. The antenna system of claim 14 wherein: said second individual-loop antenna is a first one of a plurality of individual-loop antennas disposed in the second plane.

16. The antenna system of claim 15 wherein: said third individual-loop antenna is a first one of a plurality of individual-loop antennas disposed in the third plane; and said fourth individual-loop antenna is a first one of a plurality of individual-loop antennas disposed in the fourth plane.

17. A multilayer, orthogonal individual-loop antenna comprising:

a first plurality of individual-loop antennas disposed in a first plane; and a second plurality of individual-loop antennas disposed in a second plane parallel to and spaced apart from the first plane, each individual-loop antenna of the second plurality of individual-loop antennas in the second plane configured such that near field inductive coupling between each individual-loop antenna of the plurality of individual-loop antennas in the first and second planes is substantially zero.

18. The antenna of claim 17 further comprising a first plurality of individual-loop antennas disposed in a third plane parallel to and spaced apart from the second plane, each of the plurality of individual-loop antennas in the first, second and third planes configured such that near field inductive coupling between each of the plurality of individual-loop antennas in the first, second and third planes is substantially zero.

19. The antenna system of claim 17 wherein said plurality of individual loop antennas are provided having a shape corresponding to one of:

a square shape;
a rectangular shape;
a triangular shape;
a semicircular shape;
an oval shape; and
a semi-oval shape.

20. A multilayer, orthogonal individual-loop antenna comprising:

a first plurality of N individual-loop antenna sets, each of said N individual-loop antenna sets comprising a second plurality of M individual-loop antennas and each of said N individual-loop antenna sets disposed in a corresponding one of a plurality of K planes with each plane of said K planes being spaced apart from and parallel to the other planes in said plurality of K planes and each of the M individual-loop antennas in said N individual-loop antenna sets configured such that near field inductive coupling between each of the plurality of individual-loop antennas in the plurality of K planes is substantially zero.

21. The antenna of claim 20 wherein M=N.

22. The antenna of claim 20 wherein M=N=K.

23. The antenna of claim 20 where M=K.

24. The antenna of claim 20 wherein said plurality of individual-loop antennas are provided having a shape corresponding to one of:

a square shape;
a rectangular shape;
a triangular shape;
a semicircular shape;
a circular shape;
an oval shape; and
a semi-oval shape.

* * * * *